US006941980B2

(12) United States Patent
Rocchio et al.

(10) Patent No.: US 6,941,980 B2
(45) Date of Patent: Sep. 13, 2005

(54) APPARATUS AND METHOD FOR FILLING A RECEPTACLE WITH POWDER

(75) Inventors: Michael J. Rocchio, Hayward, CA (US); Gordon Stout, El Cerrito, CA (US); Steve Deming, San Jose, CA (US); Diane Brannigan, Belmont, CA (US); Derrick J. Parks, Belmont, CA (US); Dale Ploeger, Menlo Park, CA (US)

(73) Assignee: Nektar Therapeutics, San Carlos, CA (US)

( * ) Notice: Subject to any disclaimer, the term of this patent is extended or adjusted under 35 U.S.C. 154(b) by 0 days.

(21) Appl. No.: 10/430,692

(22) Filed: May 5, 2003

(65) Prior Publication Data

US 2004/0003866 A1 Jan. 8, 2004

Related U.S. Application Data

(60) Provisional application No. 60/392,069, filed on Jun. 27, 2002.

(51) Int. Cl.[7] ..... B65B 1/04
(52) U.S. Cl. ..... 141/67; 141/71
(58) Field of Search ..... 141/67, 71, 81, 141/146, 238, 240, 242; 222/168, 168.5, 25, 41–44

(56) References Cited

U.S. PATENT DOCUMENTS

| | | | | |
|---|---|---|---|---|
| 2,540,059 | A | | 1/1951 | Stirn et al. |
| 2,646,912 | A | * | 7/1953 | Reveno |
| 3,324,902 | A | * | 6/1967 | Lense |
| 3,554,412 | A | * | 1/1971 | Hayashi ..... 141/144 |
| 3,991,761 | A | | 11/1976 | Cocozza |
| 4,062,386 | A | * | 12/1977 | Zanasi ..... 141/258 |
| 4,247,066 | A | | 1/1981 | Frost et al. |
| 4,524,769 | A | | 6/1985 | Wetterlin |
| 4,846,876 | A | | 7/1989 | Draber et al. |
| 4,995,385 | A | | 2/1991 | Valentini et al. |
| 5,377,727 | A | | 1/1995 | Ueda et al. |
| 5,415,162 | A | | 5/1995 | Casper et al. |
| 5,458,135 | A | | 10/1995 | Patton et al. |
| 5,785,049 | A | | 7/1998 | Smith et al. |
| 5,826,633 | A | | 10/1998 | Parks et al. |
| 5,865,012 | A | | 2/1999 | Hansson et al. |
| 5,922,675 | A | | 7/1999 | Baker et al. |
| 6,182,712 | B1 | | 2/2001 | Stout et al. |
| 6,230,707 | B1 | | 5/2001 | Hörlin |
| 6,257,233 | B1 | | 7/2001 | Burr et al. |
| 6,357,490 | B1 | | 3/2002 | Johnston et al. |
| 6,390,330 | B2 | * | 5/2002 | Runft ..... 222/41 |
| 6,606,992 | B1 | | 8/2003 | Schuler et al. |

FOREIGN PATENT DOCUMENTS

| | | |
|---|---|---|
| WO | 95/24183 | 9/1995 |
| WO | 96/32096 | 10/1996 |
| WO | 96/32149 | 10/1996 |
| WO | 97/27892 | 8/1997 |
| WO | 99/16419 | 4/1999 |
| WO | 99/16422 | 4/1999 |
| WO | 00/07572 | 2/2000 |
| WO | 00/72904 | 12/2000 |
| WO | 02/15839 | 2/2002 |

OTHER PUBLICATIONS

U.S. Appl. No. 60/343,310, filed Dec. 21, 2001, Schuler et al.

* cited by examiner

*Primary Examiner*—Steven O. Douglas
(74) *Attorney, Agent, or Firm*—Guy V. Tucker

(57) ABSTRACT

An apparatus for filling a receptacle comprises a reservoir adapted to contain a supply of powder pharmaceutical formulation, a holder adapted to hold a receptacle in a position where it may receive powder from the reservoir, an extension extending above the receptacle, and a plunger moveable within the extension, whereby powder from the supply may fill the receptacle and at least a portion of the extension and the plunger may force the powder in the extension into the receptacle. In one version, the plunger may be a portion of the receptacle or may be adapted to install a portion of the receptacle. Alternatively, vibrational or other energy may be used to cause powder in the extension to be filled in the receptacle.

32 Claims, 5 Drawing Sheets

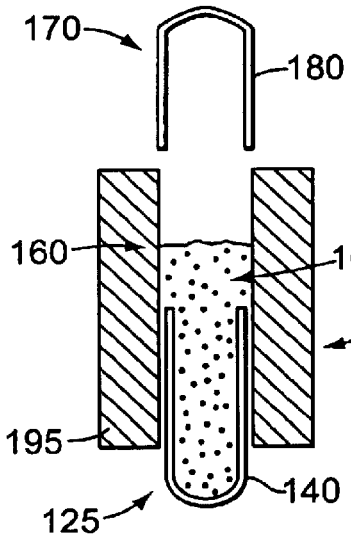
Figure 3A
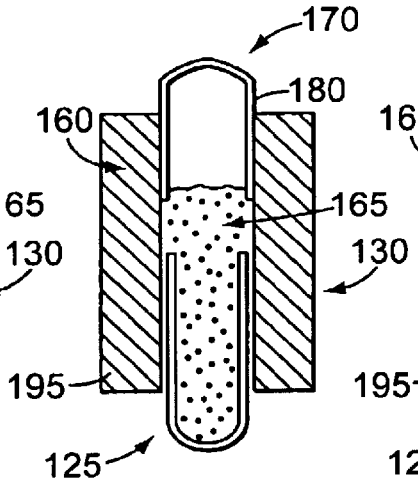
Figure 3B
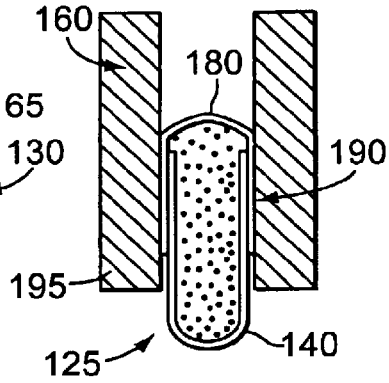
Figure 3C
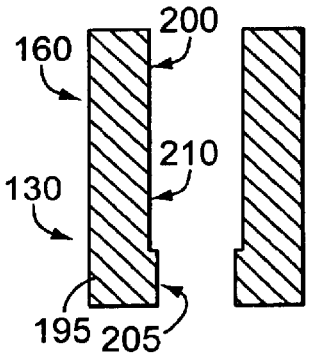
Figure 3D
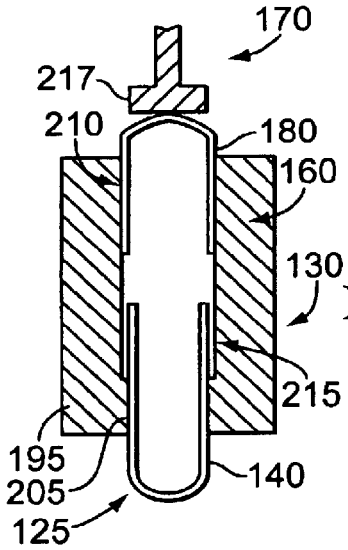
Figure 3E
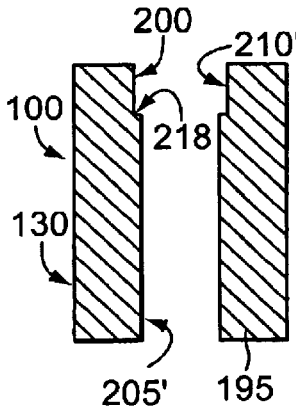
Figure 3F
Figure 3G
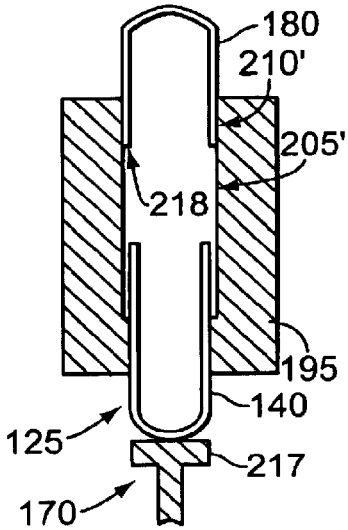

APPARATUS AND METHOD FOR FILLING A RECEPTACLE WITH POWDER

BACKGROUND

The present application claims the benefit of U.S. Provisional Application No. 60/392,069 filed on Jun. 27, 2002, the full disclosure of which is incorporated herein by reference.

The need for effective therapeutic treatment of patients has resulted in the development of a variety of techniques for delivering a pharmaceutical formulation to a patient. One traditional technique involves the oral delivery of a pharmaceutical formulation in the form of a pill, capsule, or the like. Inhaleable drug delivery, where an aerosolized pharmaceutical formulation is orally or nasally inhaled by a patient to deliver the formulation to the patient's respiratory tract, has also proven to be an effective manner of delivery. In one inhalation technique, a pharmaceutical formulation is delivered deep within a patient's lungs where it may be absorbed into the blood stream. Many types of inhalation devices exist including devices that aerosolize a dry powder pharmaceutical formulation.

The pharmaceutical formulation is often packaged in a receptacle so that it may be made available to a user. For example, a dose or a portion of a dose may be stored in a capsule that is to be swallowed or from which the pharmaceutical formulation may be aerosolized. Typically, the capsule is composed of bottom portion which may be filled with the pharmaceutical formulation. Thereafter, a top portion is installed onto the bottom portion to form the capsule and to contain the pharmaceutical formulation therein. Alternatively, the pharmaceutical formulation may be stored between layers of a multi-layered package, conventionally referred to as a blister or blister pack. With this type of receptacle, a cavity is formed in a lower layer, the pharmaceutical formulation is deposited within the cavity, and an upper layer is sealed onto the lower layer, such as by heating and/or compressing the layers, to secure the pharmaceutical formulation within the cavity. Other packages, such as bottles, vials, and the like, may also be used as receptacles for storing the pharmaceutical formulation.

It is often difficult to effectively fill packages with the pharmaceutical formulation. For example, in some conventional filling systems the amount of a pharmaceutical formulation that can be filled into a receptacle is limited. Powder pharmaceutical formulations that are to be aerosolized for delivery to a user by inhalation can be particularly difficult to package in large doses. It is generally desirable to maintain these powders in a substantially fluffy condition so that they may be effectively aerosolized. However, a fluffy powder may have such a low bulk density that less than desirable amounts of the pharmaceutical formulation may be filled into a receptacle.

Therefore, it is desirable to be able to fill large amounts of a powder into a receptacle. It is further desirable to be able to fill large amounts of a powder pharmaceutical formulation into a receptacle. It is still further desirable to fill the pharmaceutical formulation into a receptacle in a manner that allows the pharmaceutical formulation to be effectively aerosolized.

SUMMARY

The present invention satisfies these needs. In one aspect of the invention, a receptacle is filled using an extension that extends above the receptacle and that assists in filling the receptacle with powder.

In another aspect of the invention, an apparatus for filling a receptacle comprises a reservoir adapted to contain a supply of powder pharmaceutical formulation, a holder adapted to hold a receptacle in a position where it may receive powder from the reservoir, an extension extending above the receptacle, and a plunger moveable within the extension, whereby powder from the supply may fill the receptacle and at least a portion of the extension and the plunger may force the powder in the extension into the receptacle.

In another aspect of the invention, an apparatus for filling a receptacle comprises a reservoir adapted to contain a supply of powder pharmaceutical formulation; a holder adapted to hold a receptacle in a position where it may receive powder from the reservoir, an extension extending above the receptacle, and a powder compactor, whereby powder from the supply may fill the receptacle and at least a portion of the extension and the powder compactor may compact the powder so that it may be received in the receptacle.

In another aspect of the invention, an apparatus for filling a comprises a reservoir adapted to contain a supply of powder pharmaceutical formulation; a holder adapted to hold a bottom portion of a capsule in a position where it may receive powder from the reservoir, and an extension extending above the bottom portion of the capsule, whereby powder from the supply may fill the bottom portion of the capsule and at least a portion of the extension and a top portion of the capsule may be adjoined to the bottom portion to capture the powder in the bottom portion and in the extension in the adjoined capsule.

In another aspect of the invention, a method of filling a receptacle with a powder pharmaceutical formulation comprises providing a receptacle having an opening; providing an extension extending above the opening; over-filling the receptacle with powder pharmaceutical formulation so that at least a portion of the extension contains powder; and forcing the powder in the extension into the receptacle.

In another aspect of the invention, a method of filling a receptacle with a powder pharmaceutical formulation comprises providing a receptacle having an opening; providing an extension extending above the opening; over-filling the receptacle with powder pharmaceutical formulation so that at least a portion of the extension contains powder; and compacting the powder so that the powder in the extension may be received in the receptacle.

In another aspect of the invention, a method of filling a receptacle with a powder pharmaceutical formulation comprises providing bottom portion of a capsule; providing an extension extending above the bottom portion of a capsule; over-filling the bottom portion of a capsule with powder pharmaceutical formulation so that at least a portion of the extension contains powder; and adjoining a top portion of a capsule to the bottom portion to capture the powder in the extension within the adjoined capsule.

In another aspect of the invention, a pharmaceutical receptacle is filled by providing a receptacle having an opening; providing an extension extending above the opening; over-filling the receptacle with powder pharmaceutical formulation so that at least a portion of the extension contains powder; and forcing the powder in the extension into the receptacle.

In another aspect of the invention, a pharmaceutical receptacle is filled by providing a receptacle having an opening; providing an extension extending above the opening; over-filling the receptacle with powder pharmaceutical formulation so that at least a portion of the extension contains powder; and compacting the powder so that the powder in the extension may be received in the receptacle.

In another aspect of the invention, a pharmaceutical receptacle is filled by providing bottom portion of a capsule; providing an extension extending above the bottom portion of a capsule; over-filling the bottom portion of a capsule with powder pharmaceutical formulation so that at least a portion of the extension contains powder; and adjoining a top portion of a capsule to the bottom portion to capture the powder in the extension within the adjoined capsule.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

FIGS. 3A–3G show schematic sectional side views of various aspects of a receptacle filling process;

FIGS. 6A–6C are schematic sectional side views of another version of a receptacle filling apparatus and process;

DESCRIPTION

The present invention relates to filling a receptacle with a powder, such as a powder pharmaceutical formulation. Although the process is illustrated in the context of packaging a dry powder pharmaceutical formulation for inhalation, the present invention can be used in other processes and should not be limited to the examples provided herein.

Figure 1A:
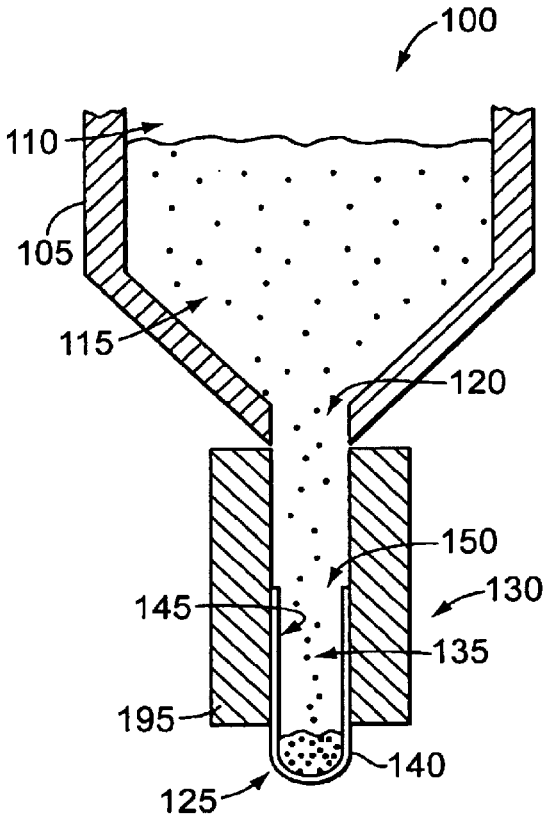
FIGS. 1A–1C are schematic sectional side views of a powder filling apparatus of the invention in use filling a receptacle.

A powder filling apparatus 100 according to the present invention is shown schematically in FIG. 1A. The powder filling apparatus 100 comprises a reservoir 105 having an interior 110 capable of containing a bed of powder 115, such as a powder pharmaceutical formulation. The reservoir 105, which may be of any suitable size and shape, comprises an outlet 120 through which fluidized powder may flow. A receptacle 125 is held in proximity to the outlet 120 by a holder 130 so that powder flowing through the outlet will be received in a chamber 135 in the receptacle 125.

The receptacle 125 may be filled with a dose of the pharmaceutical formulation. The dose may be a predetermined amount of the pharmaceutical formulation that is to be administered to a patient or may be a portion of the amount to be administered. The dose may be a particular weight or a particular volume of the pharmaceutical formulation. For example, if it desirable to administer 20 mg of a pharmaceutical formulation to patient, the dose in the receptacle may be 20 mg if one receptacle is to be use, may be 10 mg if the contents of two receptacles are to be administered, may be 5 mg if the contents of four receptacles are to the administered, etc. The dosing of the pharmaceutical formulation in the receptacle 125 may be performed by various techniques. For example, in one version, powder may be allowed to flow through the outlet 120 for an amount of time associated with a dose. In another version, the receptacle may be positioned to receive the powder for the amount of time associated with a dose. These versions are most useful when the powder is known to flow at a substantially constant rate. In another version, the weight or volume of the powder in the receptacle 125 may be detected to determine when the dose is filled. In one particular version the receptacle 125, and optionally the holder 130, are pre-weighed and are then continuously or periodically weighed during the filling process. When the weight of powder is determined to be the dosage amount, no more powder is provided to the receptacle 125.

In one version, the receptacle 125 comprises a bottom portion 140 of a capsule that is to be swallowed or from which the pharmaceutical formulation may be aerosolized. The capsule may be of a suitable shape, size, and material to contain the pharmaceutical formulation and to provide the pharmaceutical formulation 110 in a usable condition. For example, the capsule may comprise a wall 145 which comprises a material that does not adversely react with the pharmaceutical formulation. In addition, the wall 145 may comprise a material that allows the capsule to be opened to allow the pharmaceutical formulation to be aerosolized. In one version, the wall 154 comprises one or more of gelatin, hydroxypropyl methylcellulose (HPMC), polyethyleneglycol-compounded HPMC, hydroxyproplycellulose, agar, or the like. In one version, the capsule may comprise telescopically adjoining sections, as described for example in U.S. Pat. No. 4,247,066 which is incorporated herein by reference in its entirety. The size of the capsule may be selected to adequately contain the dose of the pharmaceutical formulation. The sizes generally range from size 5 to size 000 with the outer diameters ranging from about 4.91 mm to 9.97 mm, the heights ranging from about 11.10 mm to about 26.14 mm, and the volumes ranging from about 0.13 ml to about 1.37 ml, respectively. Suitable capsules are available commercially from, for example, Shionogi Qualicaps Co. in Nara, Japan and Capsugel in Greenwood, S.C. After filling, a top portion may be placed over the bottom portion 140 to form the a capsule shape and to contain the powder within the capsule, as described in U.S. Pat. No. 4,846,876, U.S. Pat. No. 6,357,490, and in the PCT application WO 00/07572 published on Feb. 17, 2000, all of which are incorporated herein by reference in their entireties.

Figure 1B:
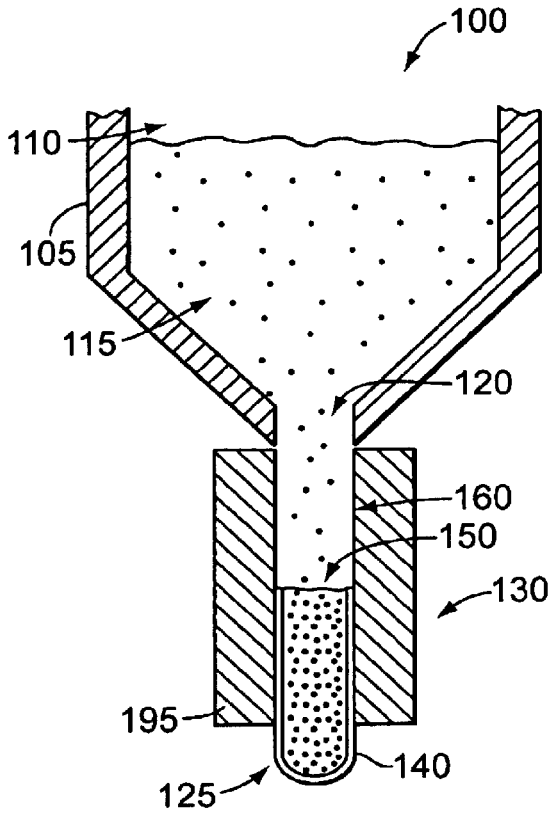

As shown in FIG. 1A, the powder in the reservoir 115 flows through the outlet 120 and into an opening 150 in the bottom portion 140 of the capsule. This filling continues until a dose of the pharmaceutical formulation is introduced into the bottom portion 140. The bottom portion 140 may be filled with powder up to the level of the opening 150, as shown in FIG. 1B. The dose associated with this level of filling is dependent on the type of filling process used since each type of filler fills the bottom portion 140 with powder at a certain bulk filling density. Thus, a filling apparatus 100 that fills with a high bulk filling density can fill a larger weight dose into the bottom portion 140 than a filling apparatus 100 that fills with a lower bulk filling density.

Figure 1C:
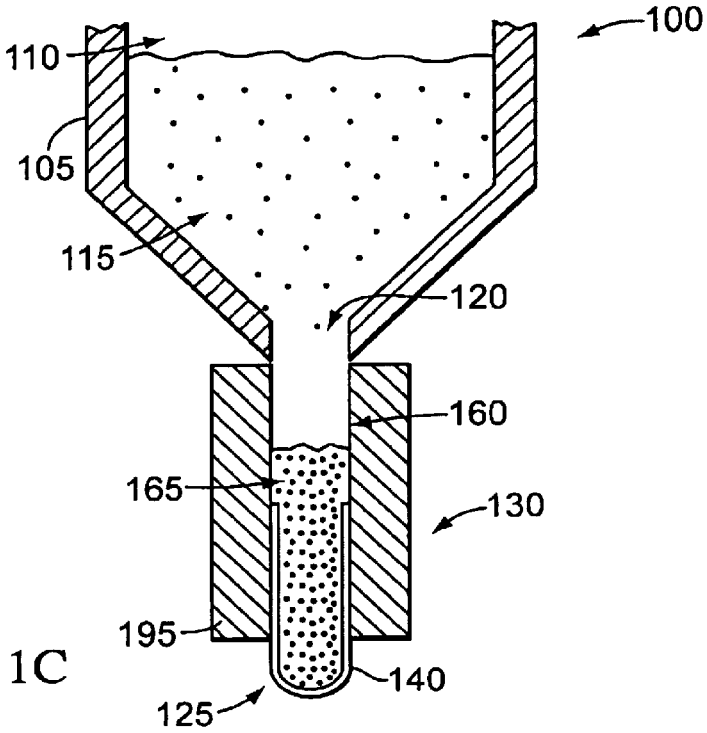

In come cases, the bulk filling density is lower than is necessary for effective administration of the pharmaceutical formulation. In these cases, the capsule is capable of containing a larger dose of the pharmaceutical formulation than the amount shown in FIG. 1B. Therefore, to increase the dosage carrying capability of the capsule, the bottom portion 140 may be over-filled. For example, as shown in FIG. 1C, an extension 160 is provided that extends above the opening 150. In the version shown, the extension is of substantially the same size and shape as the opening 150, but it may be of different size and shape if desired. Powder pharmaceutical formulation continues to flow from the reservoir 105 to the bottom portion 140 and extension 160 until the dose amount is provided. The dosage comprises an overfilled portion 165 that is within the extension 160 above the opening 150 of the bottom portion 140 of the capsule.

Figure 2A:
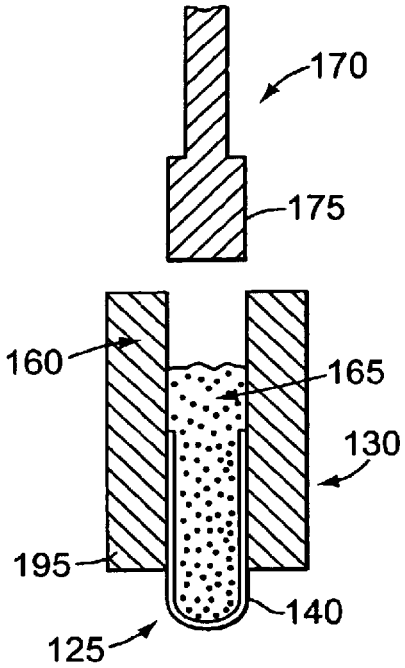
FIGS. 2A and 2B are schematic sectional side views of a extension and receptacle during a receptacle filling process.
Figure 2B:
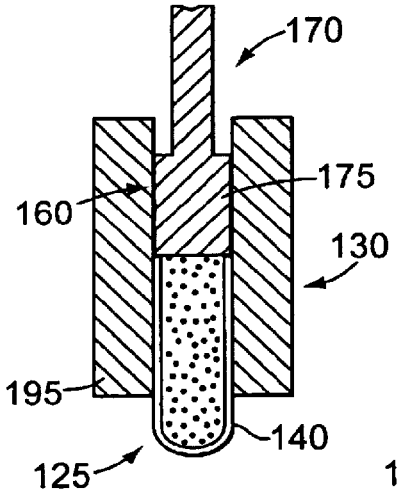
Figure 2C:
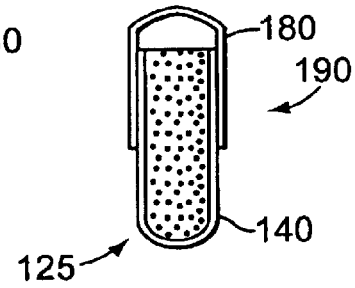
FIG. 2C is a schematic sectional side view of a receptacle filled in accordance with the present invention.
Figure 2D:
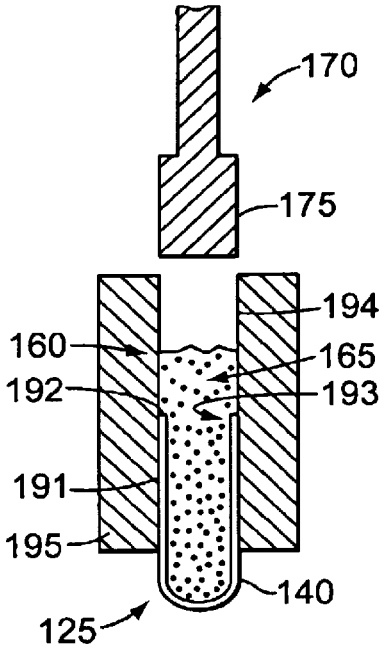
FIGS. 2D and 2E are schematic section side views of another version of an extension.
Figure 2E:
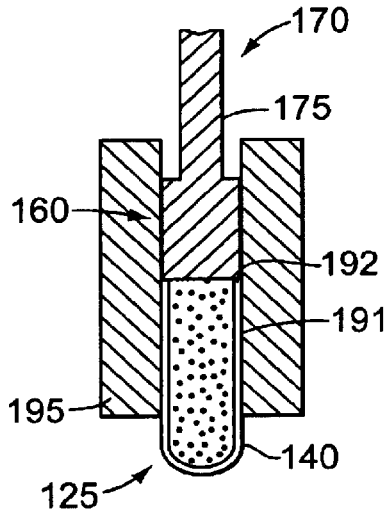

The bottom portion 140 of the capsule is then filled with the entire dose by forcing the overfilled portion 165 into the bottom portion 140. In one version, a plunger 170 may be provided in the portion 165 to force the overfilled portion 165 toward the bottom portion 140 of the capsule. For example, as shown in FIG. 2A, the plunger 170 may comprise a piston 175 that is moveable with the extension 160. The piston 175 is caused to move manually or mechanically to a position near the opening 150, as shown in FIG. 2B. The entire dose is then contained within the bottom portion 140 of the capsule. The top portion 180 is then adjoined to the bottom portion 145 to form the capsule 190 with the pharmaceutical formulation contained therein, as shown in FIG. 2C. In another version, as shown in FIGS. 2D and 2E, the extension 160 may comprise an undercut section 191 that accommodates the bottom portion 140. The undercut section 191 may be approximately the thickness of the thickness of the wall of the bottom portion 140 and may terminate at a shoulder 192 so that the bottom portion 140 may reside in the undercut section 191 and provide a substantially smooth transition 193 between the interior of the bottom portion 140 and the non-undercut section 194 of the extension 160. As shown in FIG. 2E, with this version, the piston 175 does not contact the bottom section 140 during compaction, and there is a reduced risk of damage to the bottom portion 140.

In one version, the extension 160 may be integrally formed with the holder 130. For example, in the version of FIGS. 1A–1C, the holder 130 comprises a sleeve 195 having an internal wall 200. The internal wall 200 is sized and shaped to engage the sidewalls of the bottom portion 140 of the capsule. The sleeve 195 extends above the opening 150 to form the extension 160. The sleeve may be formed of any rigid or semi-rigid material that may contact the powder without causing deleterious effects. For example, the sleeve may comprise one or more of a metal, such as stainless steel, a ceramic, a high strength polymer, a composite, and the like. At least a portion of the sleeve internal wall 200 may be of a dimension that allows it to securely hold the bottom portion 140 of the capsule or to hold another type of receptacle 125. For example, to hold a size 2 capsule, the internal wall 200 may have a diameter of about 6.3 mm.

In another version, the plunger 170 for forcing the overfill portion 165 into the receptacle 125 comprises a portion of the receptacle. For example, as shown in FIGS. 3A through 3C, the plunger 170 may comprise the top portion 180 of the capsule. In this version, after the dose is filled into the bottom portion 140 and the extension 160, the top portion 180 is inserted into the extension 160 and the portions are brought toward one another by moving the top portion 180 down and/or by moving the bottom portion 140 up. The portions adjoin to form the capsule 190. The plunger 170 may also comprise a member that engages the top portion 180 and/or the bottom portion 140 to drive the portions. Alternatively, the portions may be moved manually. FIGS. 3D and 3E show a version of a sleeve 195 that allows for easy adjoining of the portions. In this version, the wall 200 of the sleeve 195 includes a first portion 205 having a first dimension that is sized to securely hold the bottom portion 140 of the capsule. A second portion 210 of the wall 200 has a larger dimension than the first portion 205 to allow the slightly larger diameter top portion 180 of the capsule to slide more easily therein. Also, the larger dimensioned portion creates a space 215 between the top of the bottom portion 140 and the wall 200 to allow the top portion 180 to slide over the bottom portion 140. As also shown in FIG. 3E, the plunger 170 may also comprise a piston 217 that is used to push or otherwise move the top portion 180. Another version of the sleeve 195 is shown in FIGS. 3F and 3G. In this version, the second portion 210' includes a shoulder surface 218 that may abut the end of the top portion 180. In this version, the bottom portion 140 may be slid along the first surface 205' and into the top portion 180 as shown in FIG. 3G without substantial amounts of powder being collected in residual spaces. In this version, the plunger may thus comprise the bottom portion 140 and/or a piston 217.

Figure 4A:
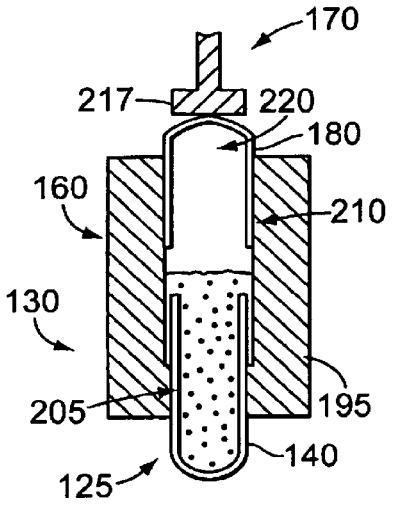
FIGS. 4A and 4B are schematic sectional side views of another version of a receptacle filling process.
Figure 4B:
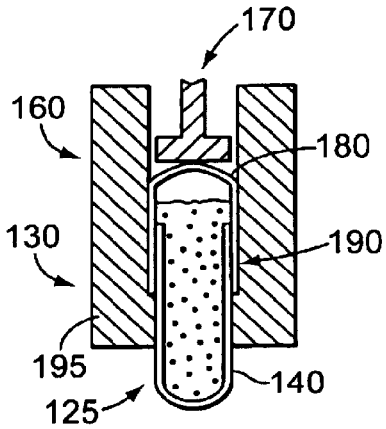

The powder filling apparatus 100 may also be used to increase the maximum dosage amount that a receptacle may carry without increasing the density of the bulk filled pharmaceutical formulation. For example, as shown in FIGS. 4A and 4B, the top portion 180 of a capsule comprises a certain volume 220 available for containing the pharmaceutical formulation. When the over-filled portion 165 is smaller than the volume 220 in the top portion 180, the top portion 180 may be adjoined to the bottom portion 140 without substantially compacting the pharmaceutical formulation.

Figure 5A:
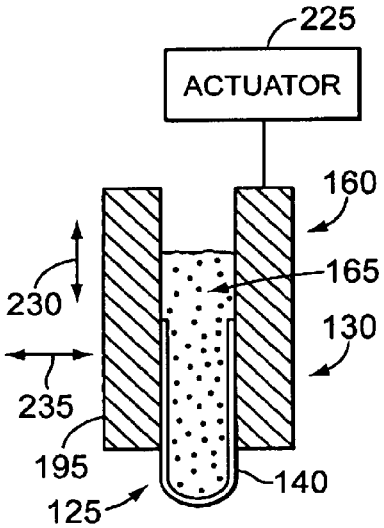
FIGS. 5A–5C are schematic sectional side views of versions of powder compactors.
Figure 5B:
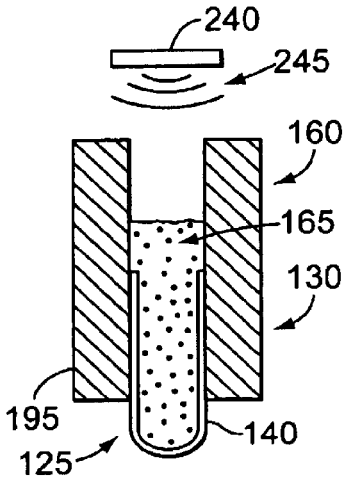
Figure 5C:
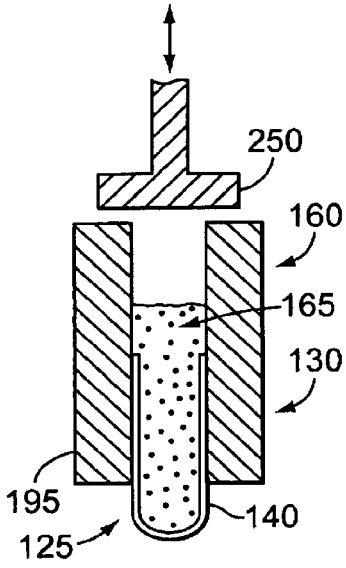

In another version, the over-filled portion 165 may be forced into the receptacle 125 by a powder compactor other than a plunger. For example, as shown in FIG. 5A, the powder may be vibrated to cause it to compact so that it may all be received in the bottom portion 140. An actuator 225, such as a vibratory motor, may be connected to the extension 160 to cause the extension 160 and/or the bottom portion 140 to vibrate in an up and down direction 230 and/or in a lateral direction 235. Alternatively or additionally, a membrane 240 may vibrate to introduce acoustic energy, such as sound waves 245, into the powder to cause compaction, as shown in FIG. 5B. In another version, as shown in FIG. 5C, a tamp 250 may be provided to impact the sleeve 195 or other part to force the powder to compact.

Figure 6A:
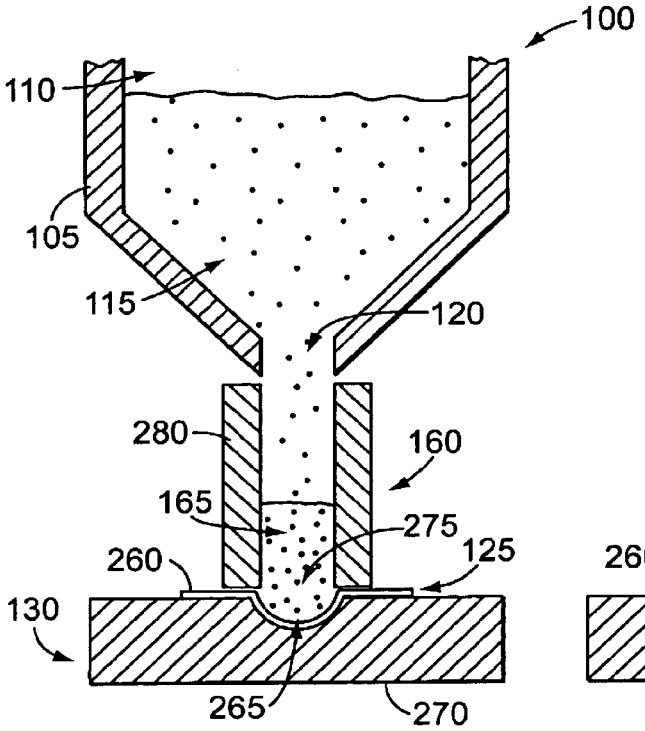
Figure 6B:
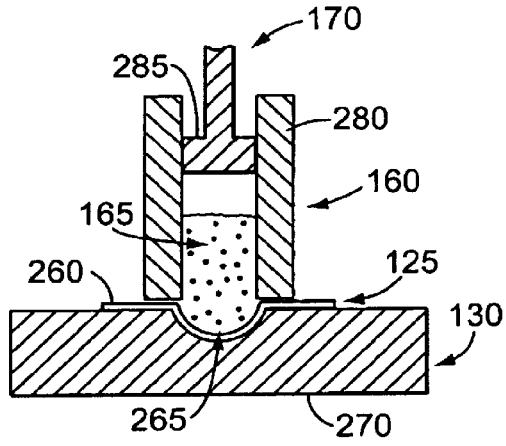
Figure 6B:
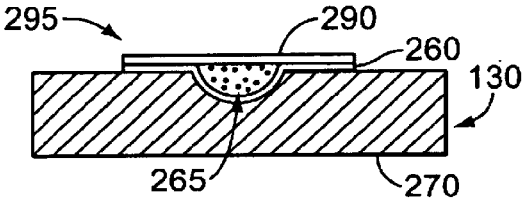

The powder filling apparatus 100 may be used to fill other receptacles 125. For example, FIG. 6A through 6C illustrate a process of filling a multi-layered package, such as a blister. A lower layer 260 of the multi-layered package comprises a cavity 265 that has been formed therein. The lower layer 260 is placed on a holder 130, such as a support 270 having a recess for receiving the cavity 265. Positioned near the opening 275 into the cavity 265 is the extension 160 which may be in the form of a sleeve 280. Powder from the reservoir 105 is introduced into the cavity 265, and if desired, is overfilled so that an overfilled portion 165 of the dose is in the extension 160. A plunger 170, such as a piston 285, or other forcing mechanism then forces the overfilled portion 165 into the cavity 265. An upper layer 290 is then sealed, such as by heat and/or compression, onto the lower layer 260 to contain the pharmaceutical formulation in the cavity 265 and to form the blister 295, as described for example in U.S. Pat. No. 5,865,012 and in U.S. Provisional Patent Application 60/343,310, filed on Dec. 21, 2001 both of which are incorporated herein by reference in their entireties. In one version, the multi-layered package may comprise a lower layer comprising a metal containing layer, such as a layer comprising aluminum, and/or an upper layer comprising a metal containing layer. The metal containing layers may be sufficiently thick to substantially prevent a significant amount of moisture from passing therethrough. For example, the metal containing layers may be from about 10 μm to about 100 μm, and more preferably from about 20 μm to about 80 μm. The lower layer and the upper layer may be sealed together by a layer of sealing material, such as a layer of lacquer that may be from about 1 μm to about 20 μm. In another portion, the receptacle may comprise a container such as a bottle, vial or the like. For example, the container may be use to contain multiple doses of a powder pharmaceutical formulation, such as a container described in U.S. Pat. No. 4,524,769 which is incorporated herein by reference in its entirety.

Figure 6D:
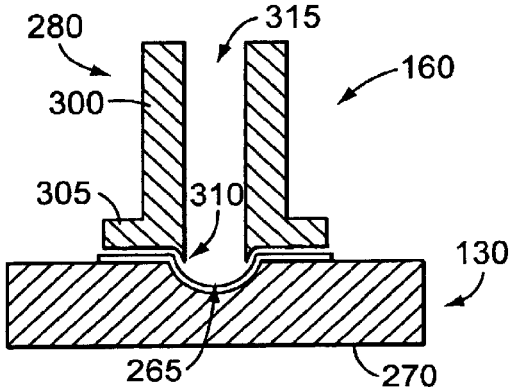
FIG. 6D is a schematic sectional side view of a version of an extension member.

The sleeve 280 may be specifically designed for a particular filling process. For example, a version of a sleeve 300 that may be used during a multi-layered package filling process is shown in FIG. 6D. The sleeve 300 of this version comprises a stabilizing portion 305 that may rest against or near the lower layer 260. In addition, the sleeve 300 may comprise a protrusion 310 that positions the sleeve 300 so that the passageway 315 through the sleeve is aligned with the receptacle 125. For example, in the version shown, the protrusion 310 includes a portion that may extend into the cavity 265 to index the sleeve 300.

The powder filling apparatus 100 has proven to be particularly advantageous in filling dry powder inhaleable pharmaceutical formulations into receptacles 125 from which the pharmaceutical formulation may be aerosolized for inhalation by a user. For example, when in a powdered form, the powder may be initially stored in a capsule, as described in U.S. Pat. No. 4,995,385, U.S. Pat. No. 3,991,761, U.S. Pat. No. 6,230,707, and PCT Publication WO 97/27892, the capsule being openable before, during, or after insertion of the capsule into an aerosolization device. Alternatively the powder may be contained in a sealed multi-layered package, which is opened prior to aerosolization of the powder, as described in U.S. Pat. No. 5,785,049, U.S. Pat. No. 5,415,162, and U.S. patent application Ser. No. 09/583,312. In either the bulk, blister, capsule, or the like form, the powder may be aerosolized by an active element, such as compressed air, as described in U.S. Pat. No. 5,458,135, U.S. Pat. No. 5,785,049, and U.S. Pat. No. 6,257,233, or propellant, as described in PCT Publication WO 00/72904. Alternatively the powder may be aerosolized in response to a user's inhalation, as described for example in the aforementioned U.S. patent application Ser. No. 09/583,312 and U.S. Pat. No. 4,995,385. All of the above references being incorporated herein by reference in their entireties.

The powder filling apparatus 100 may be used to increase the dose amounts when filling finely divided dry powders for inhalation into a receptacle 125. Using the powder filling apparatus, the dose carrying ability of a receptacle can be increased from about 10 percent to about 200 percent, depending on the powders, the filling process, and the receptacle. For example, it has been determined that a bottom portion 140 of a capsule can be filled with about 15 mg of a low density powder pharmaceutical formulation using a conventional filler. However, using the powder filling apparatus 100 of the present invention, the capsule can be filled with more than 15 mg, more preferably more than about 20 mg, even more preferably more than about 25 mg, and most preferably from about 35 to about 40 mg of the powder. Unexpectedly, the compacted powder is able to be effectively delivered to the patient, such as by aerosolizing the pharmaceutical formulation in an conventional capsule-based aerosolization apparatus, such as the device described in U.S. Pat. No. 4,995,385 which is incorporated herein by reference in its entirety. The present invention maintains the aerosolization properties of the powder by not over-compacting the powder. Instead, the present invention compacts the powder just enough that a desired dose can be contained within a receptacle. In many cases, the powder is "de-fluffed" more than it is actually compacted.

The reservoir 105 may comprise a powder fluidizer to control the flow of powder though the outlet 120. The reservoir 105 and fluidizer may be of any conventional type. For example, the reservoir 105 may comprise a configuration where the powder flows mechanically unassisted through the outlet 120, as described in U.S. Pat. No. 5,826,633 which is incorporated herein by reference in its entirety. In another version, the reservoir 105 may have therein a moveable fluidizing member as described in U.S. Pat. Nos. 2,540,059 and 5,377,727 and/or a vibrating member as described in U.S. Pat. No. 6,182,712, all three of which are incorporated herein by reference in their entireties. In one version, the outlet 120 of the reservoir 105 deposits the powder in a transfer or metering chamber which then transfers the powder to a receptacle, as described for example in aforementioned U.S. Pat. Nos. 2,540,059; 5,826,633; and 6,182,712 and also described in PCT published application WO 02/15839 which is incorporated herein by reference in its entirety. The filling and emptying of the transfer chamber may be assisted by suction and pressurized gas. In another version, the reservoir 105 comprises a portion of an Xcelodose (TM) 120 or 600 Capsule Filling Machine from Meridica Limited in Hertfordshire, United Kingdom. In other versions, the reservoir 105 may comprise an auger feeder and/or a dosator, such as a plunger based dosator, as known in the art. The reservoir 105 may also have a plurality of outlets 120, as described in aforementioned U.S. Pat. Nos. 5,826,633 and 6,182,712 so that a plurality of chambers or receptacles may be simultaneously filled.

A computer controller may be provided to control the powder filling apparatus 100. For example, the computer controller may control the flow of powder from the reservoir and/or may control the positioning of the receptacle. For example, the controller may be responsive to a weight detector to determine when a dose of pharmaceutical formulation has been provided to the receptacle 125 or the receptacle 125 and the extension 160 and may terminate the flow of powder or cause the receptacle 125 to move out of position when the dose has been provided. The controller may be a single controller device or may be a plurality of controller devices that may be connected to one another or a plurality of controller devices that may be connected to different components of the powder filling apparatus 100.

In one embodiment, the controller comprises electronic hardware including electrical circuitry comprising integrated circuits that is suitable for operating or controlling the powder filling apparatus 100. Generally, the controller is adapted to accept data input, run algorithms, produce useful output signals, and may also be used to detect data signals from one or more sensors and other device components, and to monitor or control the process in the powder filling apparatus 100. However, the controller may merely perform one of these tasks. In one version, the controller may comprise one or more of (i) a computer comprising a central processor unit (CPU) which is interconnected to a memory system with peripheral control components, (ii) application specific integrated circuits (ASICs) that operate particular components of the powder filling apparatus 100 or operate a particular process, and (iii) one or more controller interface boards along with suitable support circuitry. Typical CPUs include the PowerPC™, Pentium™, and other such processors. The ASICs are designed and preprogrammed for particular tasks, such as retrieval of data and other information from the powder filling apparatus 100 and/or operation of particular device components. Typical support circuitry includes for example, coprocessors, clock circuits, cache, power supplies and other well known components that are in communication with the CPU. For example, the CPU often operates in conjunction with a random access memory (RAM), a read-only memory (ROM) and other storage devices well known in the art. The RAM can be used to store the software implementation of the present invention during process implementation. The programs and subroutines of the present invention are typically stored in mass storage devices and are recalled for temporary storage in RAM when being executed by the CPU.

The software implementation and computer program code product of the present invention may be stored in a memory device, such as an EPROM, and called into RAM during execution by the controller. The computer program code may be written in conventional computer readable programming languages, such as for example, assembly language, C, C", Pascal, or native assembly. Suitable program code is entered into a single file, or multiple files, using a conventional text editor and stored or embodied in a computer-usable medium, such as a memory of the computer system. If the entered code text is in a high level language, the code is compiled to a compiler code which is linked with an object code of precompiled windows library routines. To execute the linked and compiled object code, the system user invokes the object code, causing the computer system to load the code in memory to perform the tasks identified in the computer program.

In one version, the controller may comprise a microprocessor or ASIC of sufficiently small size and power consumption to be housed on or in the powder filling apparatus 100. For example, suitable microprocessors for use as a local microprocessor include the MC68HC711E9 by Motorola, the PIC16C74 by Microchip, and the 82930AX by Intel Corporation. The microprocessor can include one microprocessor chip, multiple processors and/or co-processor chips, and/or digital signal processor (DSP) capability.

The pharmaceutical formulation may comprise an active agent. The active agent described herein includes an agent, drug, compound, composition of matter or mixture thereof which provides some pharmacologic, often beneficial, effect. This includes foods, food supplements, nutrients, drugs, vaccines, vitamins, and other beneficial agents. As used herein, the terms further include any physiologically or pharmacologically active substance that produces a localized or systemic effect in a patient. An active agent for incorporation in the pharmaceutical formulation described herein may be an inorganic or an organic compound, including, without limitation, drugs which act on: the peripheral nerves, adrenergic receptors, cholinergic receptors, the skeletal muscles, the cardiovascular system, smooth muscles, the blood circulatory system, synoptic sites, neuroeffector junctional sites, endocrine and hormone systems, the immunological system, the reproductive system, the skeletal system, pulmonary system, autacoid systems, the alimentary and excretory systems, the histamine system, and the central nervous system. Suitable active agents may be selected from, for example, hypnotics and sedatives, psychic energizers, tranquilizers, respiratory drugs, anticonvulsants, muscle relaxants, antiparkinson agents (dopamine antagonists), analgesics, anti-inflammatories, antianxiety drugs (anxiolytics), appetite suppressants, antimigraine agents, muscle contractants, anti-infectives (antibiotics, antivirals, antifungals, vaccines) antiarthritics, antimalarials, antiemetics, anepileptics, bronchodilators, cytokines, growth factors, anti-cancer agents, antithrombotic agents, antihypertensives, cardiovascular drugs, antiarrhythmics, antioxicants, anti-asthma agents, hormonal agents including contraceptives, sympathomimetics, diuretics, lipid regulating agents, anti-androgenic agents, antiparasitics, anticoagulants, neoplastics, antineoplastics, hypoglycemics, nutritional agents and supplements, growth supplements, antienteritis agents, vaccines, antibodies, diagnostic agents, and contrasting agents. The active agent, when administered by inhalation, may act locally or systemically.

The active agent may fall into one of a number of structural classes, including but not limited to small molecules, peptides, polypeptides, proteins, polysaccharides, steroids, proteins capable of eliciting physiological effects, nucleotides, oligonucleotides, polynucleotides, fats, electrolytes, and the like.

Examples of active agents suitable for use in this invention include but are not limited to one or more of calcitonin, erythropoietin (EPO), sumatriptan, leuprolide, amphotericin B, Factor VIII, Factor IX, ceredase, cerezyme, cyclosporin, granulocyte colony stimulating factor (GCSF), thrombopoietin (TPO), alpha-1 proteinase inhibitor, elcatonin, granulocyte macrophage colony stimulating factor (GMCSF), growth hormone, human growth hormone (HGH), growth hormone releasing hormone (GHRH), heparin, low molecular weight heparin (LMWH), interferon alpha, interferon beta, interferon gamma, interleukin-1 receptor, interleukin-2, interleukin-1 receptor antagonist, interleukin-3, interleukin-4, interleukin-6, luteinizing hormone releasing hormone (LHRH), factor IX, insulin, pro-insulin, insulin analogues (e.g., mono-acylated insulin as described in U.S. Pat. No. 5,922,675, which is incorporated herein by reference in its entirety), amylin, C-peptide, somatostatin, somatostatin analogs including octreotide, vasopressin, follicle stimulating hormone (FSH), insulin-like growth factor (IGF), insulintropin, macrophage colony stimulating factor (M-CSF), nerve growth factor (NGF), tissue growth factors, keratinocyte growth factor (KGF), glial growth factor (GGF), tumor necrosis factor (TNF), endothelial growth factors, parathyroid hormone (PTH), glucagon-like peptide thymosin alpha 1, IIb/IIIa inhibitor, alpha-1 antitrypsin, phosphodiesterase (PDE) compounds, VLA-4 inhibitors, bisphosponates, respiratory syncytial virus antibody, cystic fibrosis transmembrane regulator (CFTR) gene, deoxyreibonuclease (Dnase), bactericidal/permeability increasing protein (BPI), anti-CMV antibody, 13-cis retinoic acid, macrolides such as erythromycin, oleandomycin, troleandomycin, roxithromycin, clarithromycin, davercin, azithromycin, flurithromycin, dirithromycin, josamycin, spiromycin, midecamycin, leucomycin, miocamycin, rokitamycin, andazithromycin, and swinolide A; fluoroquinolones such as ciprofloxacin, ofloxacin, levofloxacin, trovafloxacin, alatrofloxacin, moxifloxicin, norfloxacin, enoxacin, grepafloxacin, gatifloxacin, lomefloxacin, sparfloxacin, temafloxacin, pefloxacin, amifloxacin, fleroxacin, tosufloxacin, prulifloxacin, irloxacin, pazufloxacin, clinafloxacin, and sitafloxacin, aminoglycosides such as gentamicin, netilmicin, paramecin, tobramycin, amikacin, kanamycin, neomycin, and streptomycin, vancomycin, teicoplanin, rampolanin, mideplanin, colistin, daptomycin, gramicidin, colistimethate, polymixins such as polymixin B, capreomycin, bacitracin, penems; penicillins including penicllinase-sensitive agents like penicillin G, penicillin V, penicillinase-resistant agents like methicillin, oxacillin, cloxacillin, dicloxacillin, floxacillin, nafcillin; gram negative microorganism active agents like ampicillin, amoxicillin, and hetacillin, cillin, and galampicillin; antipseudomonal penicillins like carbenicillin, ticarcillin, azlocillin, mezlocillin, and piperacillin; cephalosporins like cefpodoxime, cefprozil, ceftbuten, ceftizoxime, ceftriaxone, cephalothin, cephapirin, cephalexin, cephradrine, cefoxitin, cefamandole, cefazolin, cephaloridine, cefaclor, cefadroxil, cephaloglycin, cefuroxime, ceforanide, cefotaxime, cefatrizine, cephacetrile, cefepime, cefixime, cefonicid, cefoperazone, cefotetan, cefmetazole, ceftazidime, loracarbef, and moxalactam, monobactams like aztreonam; and carbapenems such as imipenem, meropenem, pentamidine isethiouate, albuterol sulfate, lidocaine, metaproterenol sulfate, beclomethasone diprepionate, triamcinolone acetamide, budesonide acetonide, fluticasone, ipratropium bromide, flunisolide, cromolyn sodium, ergotamine tartrate and where applicable, analogues, agonists, antagonists, inhibitors, and pharmaceutically acceptable salt forms of the above. In reference to peptides and proteins, the invention is intended to encompass synthetic, native, glycosylated, unglycosylated, pegylated forms, and biologically active fragments and analogs thereof.

Active agents for use in the invention further include nucleic acids, as bare nucleic acid molecules, vectors, associated viral particles, plasmid DNA or RNA or other nucleic acid constructions of a type suitable for transfection or transformation of cells, i.e., suitable for gene therapy including antisense. Further, an active agent may comprise live attenuated or killed viruses suitable for use as vaccines. Other useful drugs include those listed within the Physician's Desk Reference (most recent edition).

The amount of active agent in the pharmaceutical formulation will be that amount necessary to deliver a therapeutically effective amount of the active agent per unit dose to achieve the desired result. In practice, this will vary widely depending upon the particular agent, its activity, the severity of the condition to be treated, the patient population, dosing requirements, and the desired therapeutic effect. The composition will generally contain anywhere from about 1% by weight to about 99% by weight active agent, typically from about 2% to about 95% by weight active agent, and more typically from about 5% to 85% by weight active agent, and will also depend upon the relative amounts of additives contained in the composition. The compositions of the invention are particularly useful for active agents that are delivered in doses of from 0.001 mg/day to 100 mg/day, preferably in doses from 0.01 mg/day to 75 mg/day, and more preferably in doses from 0.10 mg/day to 50 mg/day. It is to be understood that more than one active agent may be incorporated into the formulations described herein and that the use of the term "agent" in no way excludes the use of two or more such agents.

The pharmaceutical formulation may comprise a pharmaceutically acceptable excipient or carrier which may be taken into the lungs with no significant adverse toxicological effects to the subject, and particularly to the lungs of the subject. In addition to the active agent, a pharmaceutical formulation may optionally include one or more pharmaceutical excipients which are suitable for pulmonary administration. These excipients, if present, are generally present in the composition in amounts ranging from about 0.01% to about 95% percent by weight, preferably from about 0.5 to about 80%, and more preferably from about 1 to about 60% by weight. Preferably, such excipients will, in part, serve to further improve the features of the active agent composition, for example by providing more efficient and reproducible delivery of the active agent, improving the handling characteristics of powders, such as flowability and consistency, and/or facilitating manufacturing and filling of unit dosage forms. In particular, excipient materials can often function to further improve the physical and chemical stability of the active agent, minimize the residual moisture content and hinder moisture uptake, and to enhance particle size, degree of aggregation, particle surface properties, such as rugosity, ease of inhalation, and the targeting of particles to the lung. One or more excipients may also be provided to serve as bulking agents when it is desired to reduce the concentration of active agent in the formulation.

Pharmaceutical excipients and additives useful in the present pharmaceutical formulation include but are not limited to amino acids, peptides, proteins, non-biological polymers, biological polymers, carbohydrates, such as sugars, derivatized sugars such as alditols, aldonic acids, esterified sugars, and sugar polymers, which may be present singly or in combination. Suitable excipients are those provided in WO 96/32096, which is incorporated herein by reference in its entirety. The excipient may have a glass transition temperatures (Tg) above about 35° C., preferably above about 40° C., more preferably above 45° C., most preferably above about 55° C.

Exemplary protein excipients include albumins such as human serum albumin (HSA), recombinant human albumin (rHA), gelatin, casein, hemoglobin, and the like. Suitable amino acids (outside of the dileucyl-peptides of the invention), which may also function in a buffering capacity, include alanine, glycine, arginine, betaine, histidine, glutamic acid, aspartic acid, cysteine, lysine, leucine, isoleucine, valine, methionine, phenylalanine, aspartame, tyrosine, tryptophan, and the like. Preferred are amino acids and polypeptides that function as dispersing agents. Amino acids falling into this category include hydrophobic amino acids such as leucine, valine, isoleucine, tryptophan, alanine, methionine, phenylalanine, tyrosine, histidine, and proline. Dispersibility-enhancing peptide excipients include dimers, trimers, tetramers, and pentamers comprising one or more hydrophobic amino acid components such as those described above.

Carbohydrate excipients suitable for use in the invention include, for example, monosaccharides such as fructose, maltose, galactose, glucose, D-mannose, sorbose, and the like; disaccharides, such as lactose, sucrose, trehalose, cellobiose, and the like; polysaccharides, such as raffinose, melezitose, maltodextrins, dextrans, starches, and the like; and alditols, such as mannitol, xylitol, maltitol, lactitol, xylitol sorbitol (glucitol), pyranosyl sorbitol, myoinositol and the like.

The pharmaceutical formulation may also include a buffer or a pH adjusting agent, typically a salt prepared from an organic acid or base. Representative buffers include organic acid salts of citric acid, ascorbic acid, gluconic acid, carbonic acid, tartaric acid, succinic acid, acetic acid, or phthalic acid, Tris, tromethamine hydrochloride, or phosphate buffers.

The pharmaceutical formulation may also include polymeric excipients/additives, e.g., polyvinylpyrrolidones, derivatized celluloses such as hydroxymethylcellulose, hydroxyethylcellulose, and hydroxypropylmethylcellulose, Ficolls (a polymeric sugar), hydroxyethylstarch, dextrates (e.g., cyclodextrins, such as 2-hydroxypropyl-β-cyclodextrin and sulfobutylether-β-cyclodextrin), polyethylene glycols, and pectin.

The pharmaceutical formulation may further include flavoring agents, taste-masking agents, inorganic salts (for example sodium chloride), antimicrobial agents (for example benzalkonium chloride), sweeteners, antioxidants, antistatic agents, surfactants (for example polysorbates such as "TWEEN 20" and "TWEEN 80"), sorbitan esters, lipids (for example phospholipids such as lecithin and other phosphatidyicholines, phosphatidylethanolamines), fatty acids and fatty esters, steroids (for example cholesterol), and chelating agents (for example EDTA, zinc and other such suitable cations). Other pharmaceutical excipients and/or additives suitable for use in the compositions according to the invention are listed in "Remington: The Science & Practice of Pharmacy", $19^{th}$ ed., Williams & Williams, (1995), and in the "Physician's Desk Reference", $52^{nd}$ ed., Medical Economics, Montvale, N.J. (1998), both of which are incorporated herein by reference in their entireties.

"Mass median diameter" or "MMD" is a measure of mean particle size, since the powders of the invention are generally polydisperse (i.e., consist of a range of particle sizes). MMD values as reported herein are determined by centrifugal sedimentation, although any number of commonly employed techniques can be used for measuring mean particle size. "Mass median aerodynamic diameter" or "MMAD" is a measure of the aerodynamic size of a dispersed particle. The aerodynamic diameter is used to describe an aerosolized powder in terms of its settling behavior, and is the diameter of a unit density sphere having the same settling velocity, generally in air, as the particle. The aerodynamic diameter encompasses particle shape, density and physical size of a particle. As used herein, MMAD refers to the midpoint or median of the aerodynamic particle size distribution of an aerosolized powder determined by cascade impaction.

In one version, the powdered formulation for use in the present invention includes a dry powder having a particle size selected to permit penetration into the alveoli of the lungs, that is, preferably 10 μm mass median diameter (MMD), preferably less than 7.5 μm, and most preferably less than 5 μm, and usually being in the range of 0.1 μm to 5 μm in diameter. The delivered dose efficiency (DDE) of these powders may be greater than 30%, more preferably greater than 40%, more preferably greater than 50% and most preferably greater than 60% and the aerosol particle size distribution is about 1.0–5.0 μm mass median aerodynamic diameter (MMAD), usually 1.5–4.5 μm MMAD and preferably 1.5–4.0 μm MMAD. These dry powders have a moisture content below about 10% by weight, usually below about 5% by weight, and preferably below about 3% by weight. Such powders are described in WO 95/24183, WO 96/32149, WO 99/16419, and WO 99/16422, all of which are all incorporated herein by reference in their entireties.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the relative positions of the elements in the expedients for carrying out the relative movements may be changed. Also, the various features of the versions herein can be combined in various ways to provide additional versions of the present invention. Furthermore, certain terminology has been used for the purposes of descriptive clarity, and not to limit the present invention. For example, the use of the terms such as "bottom" and "top"; "lower" and "upper"; and "first" and "second" may be reversed in the specification. Therefore, the appended claims should not be limited to the description of the preferred versions contained herein and should include all such alterations, permutations, and equivalents as fall within the true spirit and scope of the present invention.

What is claimed is:

1. An apparatus for filing a receptacle, the apparatus comprising:

a reservoir adapted to contain a supply of powder pharmaceutical formulation;

a holder adapted to hold a receptacle in a position where it may receive powder from the reservoir, an extension extending above the receptacle, and a plunger moveable within the extension, whereby powder from the supply may fill the receptacle and at least a portion of the extension and the plunger may force the powder in the extension into the receptacle.

2. An apparatus according to claim 1 wherein the plunger comprises a piston.

3. An apparatus according to claim 1 wherein the plunger comprises a portion of the receptacle.

4. An apparatus according to claim 1 wherein the holder is adapted to hold a bottom portion of a capsule.

5. An apparatus according to claim 4 wherein the plunger comprises a top portion of the capsule.

6. An apparatus according to claim 4 wherein the plunger comprises a member adapted to advance a top portion of the capsule.

7. An apparatus according to claim 1 wherein the holder is adapted to hold a cavity containing layer of a multilayered package.

8. An apparatus according to claim 1 wherein the holder and the extension are integrally formed.

9. An apparatus according to claim 1 further comprising a powder fluidizer to cause powder to flow from the reservoir to the receptacle.

10. An apparatus for filling a receptacle, the apparatus comprising:

a reservoir adapted to contain a supply of powder pharmaceutical formulation;

a holder adapted to hold a receptacle in a position where it may receive powder from the reservoir, an extension extending above the receptacle, and a powder compactor, whereby powder from the supply may fill the receptacle and at least a portion of the extension and whereby the powder compactor may compact the powder so that the powder in the portion of the extension may be received in the receptacle.

11. An apparatus according to claim 10 wherein the compactor comprises a piston.

12. An apparatus according to claim 10 wherein the compactor comprises a portion of the receptacle.

13. An apparatus according to claim 10 wherein the compactor comprises a vibrating member.

14. An apparatus according to claim 10 wherein the compactor comprises a vibrating membrane adapted to compact by the powder by acoustic energy.

15. An apparatus according to claim 10 wherein the holder is adapted to hold a bottom portion of a capsule.

16. An apparatus according to claim 15 wherein the compactor comprises a top portion of the capsule.

17. An apparatus according to claim 15 wherein the compactor comprises a member adapted to advance a top portion of the capsule.

18. An apparatus according to claim 10 wherein the holder and the extension are integrally formed.

19. An apparatus for filling a receptacle, the apparatus comprising:

a reservoir adapted to contain a supply of powder pharmaceutical formulation;

a holder adapted to hold a bottom portion of a capsule in a position where it may receive powder from the reservoir, and an extension extending above the bottom portion of the capsule, whereby powder from the supply may fill the bottom portion of the capsule and at least a portion of the extension and a top portion of the capsule may be adjoined to the bottom portion so that compacted powder is captured within the capsule.

20. An apparatus according to claim 19 wherein the top portion and/or the bottom portion is slidable within the extension.

21. An apparatus according to claim 19 wherein the top portion may be used to force the powder in the extension into the bottom portion.

22. An apparatus according to claim 19 wherein the bottom portion may be used to force the powder in the extension into the capsule.

23. A method of filling a receptacle with a powder pharmaceutical formulation, the method comprising:

providing a receptacle having an opening;

providing an extension extending above the opening;

over-filling the receptacle with powder pharmaceutical formulation so that at least a portion of the extension contains powder; and compacting the powder in the extension so that it may be captured in the receptacle.

24. A method according to claim 23 wherein the powder in the extension is compressed by a plunger.

25. A method according to claim 23 wherein the powder in the extension is compressed by a portion of the receptacle.

26. A method of filling a receptacle with a powder pharmaceutical formulation, the method comprising:

providing a receptacle having an opening;

providing an extension extending above the opening;

over-filling the receptacle with powder pharmaceutical formulation so that at least a portion of the extension contains powder; and compacting the powder so that the powder in the extension may be received in the receptacle.

27. A method according to claim 26 wherein the step of compacting comprises forcing the powder in the extension into to receptacle.

28. A method according to claim 26 wherein the step of compacting comprises vibrating the powder.

29. A method of filling a receptacle with a powder pharmaceutical formulation, the method comprising:

providing bottom portion of a capsule;

providing an extension extending above the bottom portion of a capsule;

over-filling the bottom portion of a capsule with powder pharmaceutical formulation so that at least a portion of the extension contains powder; and adjoining a top portion of a capsule to the bottom portion to capture compacted powder within the adjoined capsule.

30. A pharmaceutical receptacle filled in accordance with claim 23.

31. A pharmaceutical receptacle filled in accordance with claim 26.

32. A pharmaceutical receptacle filled in accordance with claim 29.

* * * * *